US011313094B2

(12) United States Patent
Ong

(10) Patent No.: US 11,313,094 B2
(45) Date of Patent: Apr. 26, 2022

(54) END PLATE SYSTEM FOR JOINING SPUN PILES

(71) Applicant: Chin Chai Ong, Kuala Lumpur (MY)

(72) Inventor: Chin Chai Ong, Kuala Lumpur (MY)

( * ) Notice: Subject to any disclaimer, the term of this patent is extended or adjusted under 35 U.S.C. 154(b) by 0 days.

(21) Appl. No.: 16/959,677

(22) PCT Filed: Dec. 6, 2018

(86) PCT No.: PCT/MY2018/000040
§ 371 (c)(1),
(2) Date: Jul. 2, 2020

(87) PCT Pub. No.: WO2019/139466
PCT Pub. Date: Jul. 18, 2019

(65) Prior Publication Data

US 2021/0079617 A1 Mar. 18, 2021

(30) Foreign Application Priority Data

Jan. 9, 2018 (MY) ..... PI 2018700107

(51) Int. Cl.
*E02D 5/52* (2006.01)
*E02D 5/30* (2006.01)
(Continued)

(52) U.S. Cl.
CPC ..... *E02D 5/526* (2013.01); *E02D 5/30* (2013.01); *E02D 5/223* (2013.01);
(Continued)

(58) Field of Classification Search
CPC ..... E02D 5/52; E02D 5/523; E02D 5/526; E02D 5/223; E02D 2600/20; E02D 5/30; E02D 2200/16; E02D 2300/002
See application file for complete search history.

(56) References Cited

U.S. PATENT DOCUMENTS 3,356,398 A * 12/1967 Nilsson ..... F16B 5/0044 403/331
3,504,500 A * 4/1970 Fristedt ..... E02D 5/523 405/252

(Continued)

FOREIGN PATENT DOCUMENTS

DE 1213357 B * 3/1966 ..... E02D 5/523
JP 2006002560 A * 1/2006
JP 2006207117 A * 8/2006

*Primary Examiner* — Benjamin F Fiorello
*Assistant Examiner* — Stacy N Lawson

(57) ABSTRACT

The present invention discloses an end plate system for joining spun piles together comprises a top end plate (100) mounted at a bottom end of a first spun pile: and a bottom end plate (200) mounted at a top end of a second spun pile; wherein the end plates (100, 200) respectively have an interlocking surface that is formed with a plurality of segmental protrusions (110, 210) and segmental recesses (120, 220) arranged in an alternate configuration; characterized in that each segmental protrusion (110, 210) has a first radial interlocking profile (111, 211) and a second radial interlocking profile (112, 212) that extend towards the central portion of the end plates (100, 200); wherein the top end plate (100) and the bottom end plate (200) are mated by registering the segmental protrusion (110, 210) of one end plate to the segmental recess (120, 220) of another end plate and through a rotating movement about the central axis of the mated end plates (100, 200), a first interlocking joint (300) is formed by two adjacent first radial interlocking profiles (111, 211) in full surface contact, and a second interlocking joint (400) is created by inserting a pin (402) into a passageway (401) formed between two adjacent second radial interlocking profiles (112, 212).

7 Claims, 5 Drawing Sheets

(51) Int. Cl.
*E02D 5/24* (2006.01)
*E02D 5/22* (2006.01)

(52) U.S. Cl.
CPC .... *E02D 2200/16* (2013.01); *E02D 2300/002* (2013.01); *E02D 2600/20* (2013.01)

(56) References Cited

U.S. PATENT DOCUMENTS

| | | | | |
|---|---|---|---|---|
| 9,151,010 | B2 | 10/2015 | Ong | |
| 9,739,024 | B2 | 8/2017 | Ong | |
| 2004/0253051 | A1* | 12/2004 | Napp | F16B 12/125 403/331 |
| 2019/0249387 | A1* | 8/2019 | Horie | E02D 5/24 |

* cited by examiner

END PLATE SYSTEM FOR JOINING SPUN PILES

FIELD OF INVENTION

The invention relates to the field of piles for deep foundation. More particularly, the invention is related to an end plate system for joining one end of a concrete pile to the end of another adjoining concrete pile. The end plates are provided with improved interlocking joints to secure the connection of the piles.

BACKGROUND OF THE INVENTION

The existing end plate system for joining concrete piles usually consists of two identical end plates, one mounted at the bottom end of a first concrete pile and the other mounted at the top end of a second concrete pile. Each of the end plate has an interlocking surface formed by an array of alternating protrusions and recesses. The radial sides of the protrusions are each provided with a groove extended towards the centre of the end plates. The two metal plates are mated together by registering protrusions of one end plate to the recesses of another end plate. The mating of the end plates immediately creates a plurality of passageways formed between each adjacent pair of grooves so that each passageway can permit a locking pin to be jammed there within for interlocking the end plates.

The end plates can be easily incorporated into the concrete pile without any modifications in the pile's manufacturing machinery. The process of jamming the locking pins compresses the end plates tightly together until there are little or no gaps. The jamming of the tapered locking pin into the opening of the passageway creates a post compressive force that acts like a clamp to transfer the prestressed tendons load across the end plates to resist tension and bending. As such, the system requires no welding or screws which are time consuming and prone to weakness in human workmanship. The pin can be inserted by hammering and the joint can be visually inspected to assure that the joint is permanently secured. The end plates are also designed to exceed the main body pile tension and bending moment such that the joint is stronger than the main body of the concrete pile. The examples of the abovementioned end plate system are disclosed in U.S. Pat. Nos. 9,151,010 B2 and 9,739,024 B2.

Whilst all these benefits provided, the end plate system still has its drawback. As the interlocking pins tend to rotate under tension and subsequently bends the pins. This will reduce the strength of the interlock as compared to the present invention which provides an alternate joint that does not require the use of pin. Furthermore, it reduces the installation time as the present invention only requires half the number of pins to mate the two plates together, unlike those disclosed in U.S. Pat. Nos. 9,151,010 B2 and 9,739,024 B2.

In U.S. Pat. Nos. 9,151,010 B2 and 9,739,024 B2 during the during the insertion of a first locking pin into one passageway of the mated end plates, the interlocking pin will expand the passageway by forcing a small degree of rotation in the end plates and subsequently reduces the opening size of some other passageways, therefore the tapered pins must be advanced into the passage way sequentially in a stage to interlock the joint. Whereas for the current invention, upon jamming in the first pin into a passageway, it rotates to interlock all the opposite passageway on one side and causes the passageway on the interlocking pin's side to widens for easy insertion of the subsequent pins.

In JP2006002560A, the joint disclosed by Machizawa Hiromi is secured in the wedges by forming a bolt insertion hole in a wedge and carrying out the nut bundle of the bolt which penetrates the bolt insertion hole and thereby tightened to jam the wedges. If there is more than one pair of wedges used, the height of the wedges must be increased correspondingly to avoid clashing of the bolts at the intersection of the central point of the joint device. Clearly, this joint configuration is impractical for larger diameters endplate where multiples pins are required causing the height of the wedge to increase considerably. In addition, the joint component thickness and the depth direction of each engagement part is non-uniform, therefore it can only adapt either to be casted or machined from a solid shape. This involves higher cost and more material required as compared to the current invention method of manufacturing. In the present invention, unlike a casting process, the shape of the joint in the present invention is dictated by the material flow displacement of the steel annulus plate of uniform thickness wider a single stage of Hot Forging Closed Mold process, which is cheaper, faster to mass manufacture and stronger than casting process.

It is also noted that Hiromi intended that the joint to be separable by using bolt and nuts, whereas the present invention is a permanent joint using long slender tapering pins that is jammed into the narrow passageway and held in place by friction force without any bolts nor holding device.

Accordingly, it is desirable to provide an improved end plate system that solves the problems. This invention provides such an end plate system.

SUMMARY OF INVENTION

The main aspect of the invention is to provide end plates which have improved interlocking profiles which can preferably be mass manufactured through forging in a single stage Hot Forging Closed Mould. The interlocking profiles can be transformed into two different types of interlocking joints by a rotation movement in either a clockwise or anti-clockwise direction. The first interlocking joint simultaneously interlocks the end plates by two of the adjacent interlocking profiles in full surface contact and thereby prevents the passageways from expansion during the pin insertion process, whereas the second interlocking joint is formed by inserting pins into the passageways.

Another aspect of the invention is to provide an improved end plate system which its end plates are structurally simplified such that the required number of pins is reduced and thereby shortening the pin insertion process and reduces cost.

At least one of the preceding aspects is met, in whole or in part, by the present invention, in which the embodiment of the present invention describes an end plate system for joining spun piles together comprises a top end plate mounted at a bottom end of a first spun pile; and a bottom end plate mounted at a top end of a second spun pile; wherein the end plates respectively have an interlocking surface that is formed with a plurality of segmental protrusions and segmental recesses arranged in an alternate configuration; characterized in that each segmental protrusion has a first radial interlocking profile and a second radial interlocking profile that extend towards the central portion of the end plates; wherein the top end plate and bottom end plate are mated by registering the segmental protrusion of one end plate to the segmental recess of another end plate and through a rotating movement about the central axis of the mated end plates, a first interlocking joint is formed by a pair of adjacent first radial interlocking profiles in full surface contact, and a second interlocking joint is created by inserting a pin into a passageway formed between two adjacent second radial interlocking profiles.

Preferably, the first radial interlocking profiles are identical to the second radial interlocking profiles so that the end plates can be rotated in either a clockwise or an anticlockwise direction to from the first and second interlocking joints. Alternatively, the first radial interlocking profiles are not identical to the second radial interlocking profiles.

Preferably, the first radial interlocking profiles can be configured in Z-shape, S-shape, C-shape, semi-circular shape, triangular shape, square shape, ledge shape or in any combination thereof.

Preferably, the second radial interlocking profiles can be configured in square shape, trapezoidal shape, circular shape, oval shape, diamond shape, rhombus shape, or in any combination thereof.

Preferably, the first interlocking joint and the second interlocking joint can be any combination of the above-mentioned shapes.

Preferably, the segmental recesses can be dimensioned sufficiently for receiving the segmental protrusions.

Preferably, the second radial interlocking profiles and the pins can be tapered.

Preferably, the first and second radial interlocking profiles can be formed by hot, warm or cold form press.

One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

The invention will now be described in greater detail, by way of example, with reference to the drawings.

Figure 1:
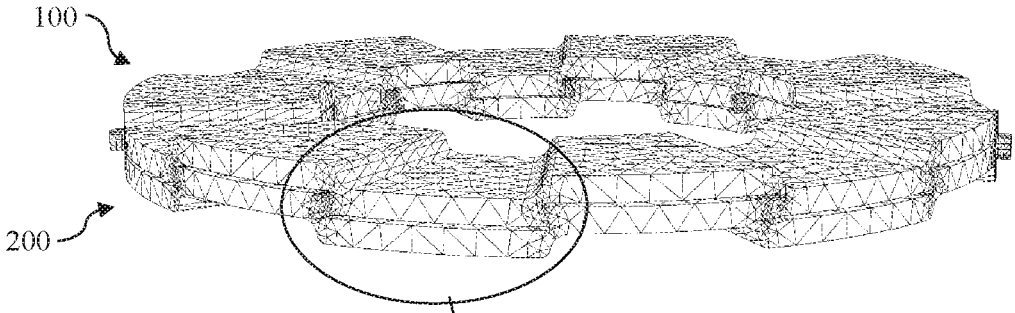
FIG. 1-1C illustrate a perspective view of the end plates in a mated configuration and enlarge views respectively taken from a first radial interlocking profiles and a second radial interlocking profiles resisting an axial pulling tension force.
Figure 2A:
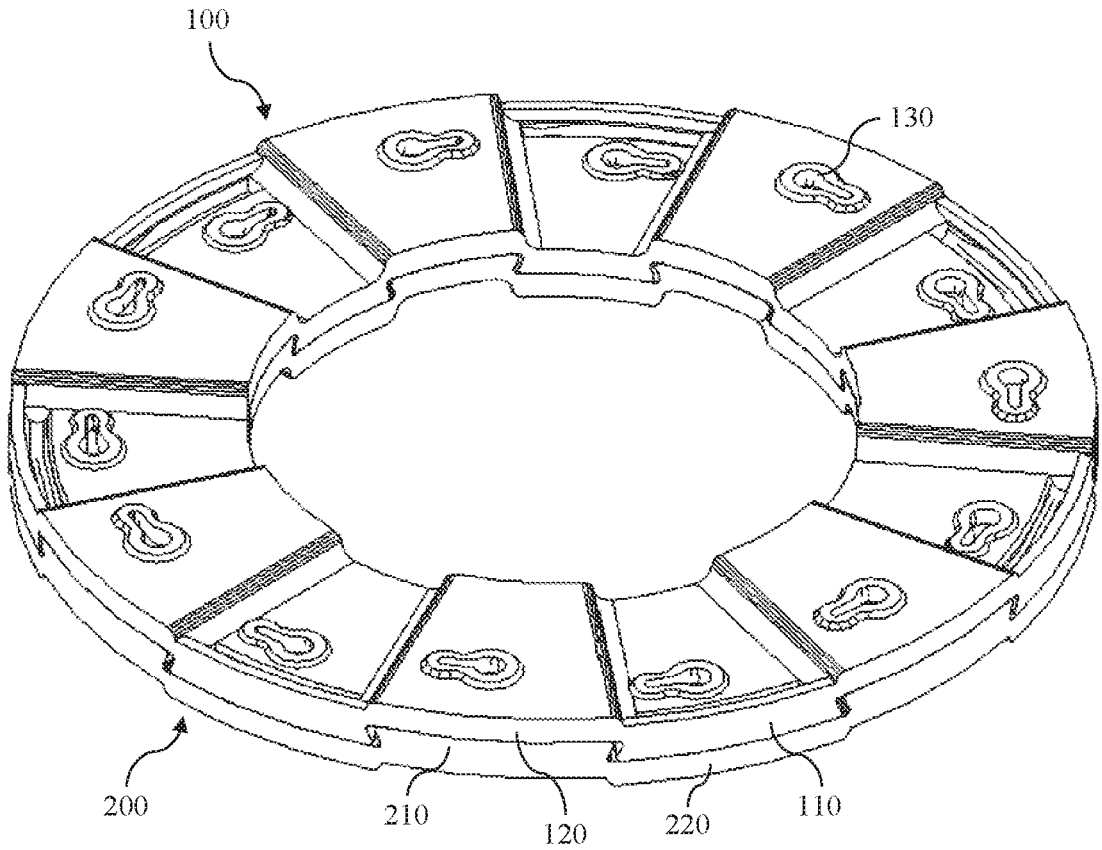
FIG. 2A illustrates a top perspective view of the end plates in the mated configuration by laying the segmental protrusion of one end plate to the segmental recess of another end plate.
Figure 2B:
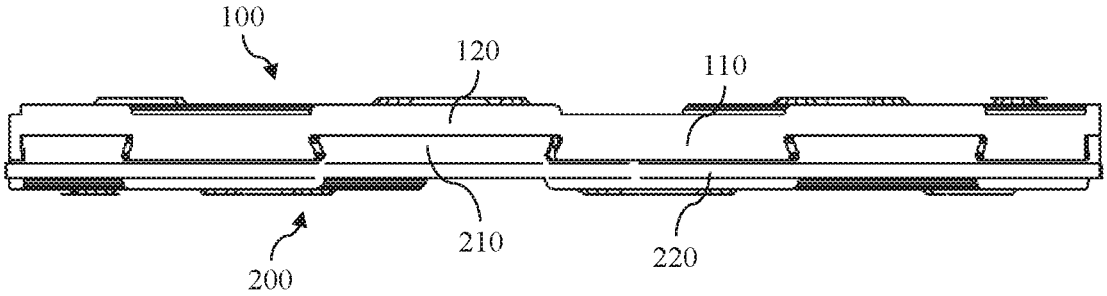
FIG. 2B illustrates a side view of the end plates in the mated configuration.

Referring to FIGS. 1 to 3, the end plate system for joining concrete piles as illustrated therein comprises a top end plate 100 which is mounted at the bottom end of a first pile, a bottom end plate 200 which is mounted at the bottom end of a second pile, the end plates 100, 200 respectively have an interlocking surface that carries a plurality of segmental protrusions 110, 210 and segmental recesses 120, 220 arranged in an alternate configuration, each segmental protrusion 110, 210 has a first radial interlocking profile 111, 211 and a second radial interlocking profile 112, 212 that extend towards the central region of the end plates 100, 200. The central region preferably includes a centre point of the end plates or the surrounding areas of the centre point whereby the longitudinal axis of the pins may be inclined radially surrounding the centre point of the mated endplates.

Preferably, the opening of each recess 120, 220 is dimensioned sufficiently to receive a segmental protrusion 110, 210. The top and bottom end plates 100, 200 are mated by registering the segmental protrusion 110, 210 of one end plate to the segmental recess 120, 220 of another end plate. Immediately after the mating of the two end plates 100, 200, each pair of adjacent radial interlocking profiles 111, 211 112, 212 forms a gap therebetween allowing the mated end plates 100, 200 to be rotated or twisted slightly about the centre axis of the end plates 100, 200 in either clockwise or anticlockwise direction. Each segmental protrusion 110, 210 and recesses 120, 220 are fabricated with a plurality of holes 130 for receiving rebars of the piles. The holes 130 are arranged in a configuration such that the rebars of the pre-stressed spun pile can be pre-tensioned and locked into the array of holes 130 and this pre-tensioned force which can be carried across the end plates 100, 200 through the jamming of pins 402.

Whilst the application of the present invention is not limited to certain type of pile, the annular shape of the end plates 100, 200 with the central opening makes the present invention suitable to be employed as a pile connector for spun piles as spun piles are constructed in round and hollow in cross section. However, it should be noted that the end plates 100, 200 can be of various shapes, including square, hexagonal, and triangle.

Figure 3A:
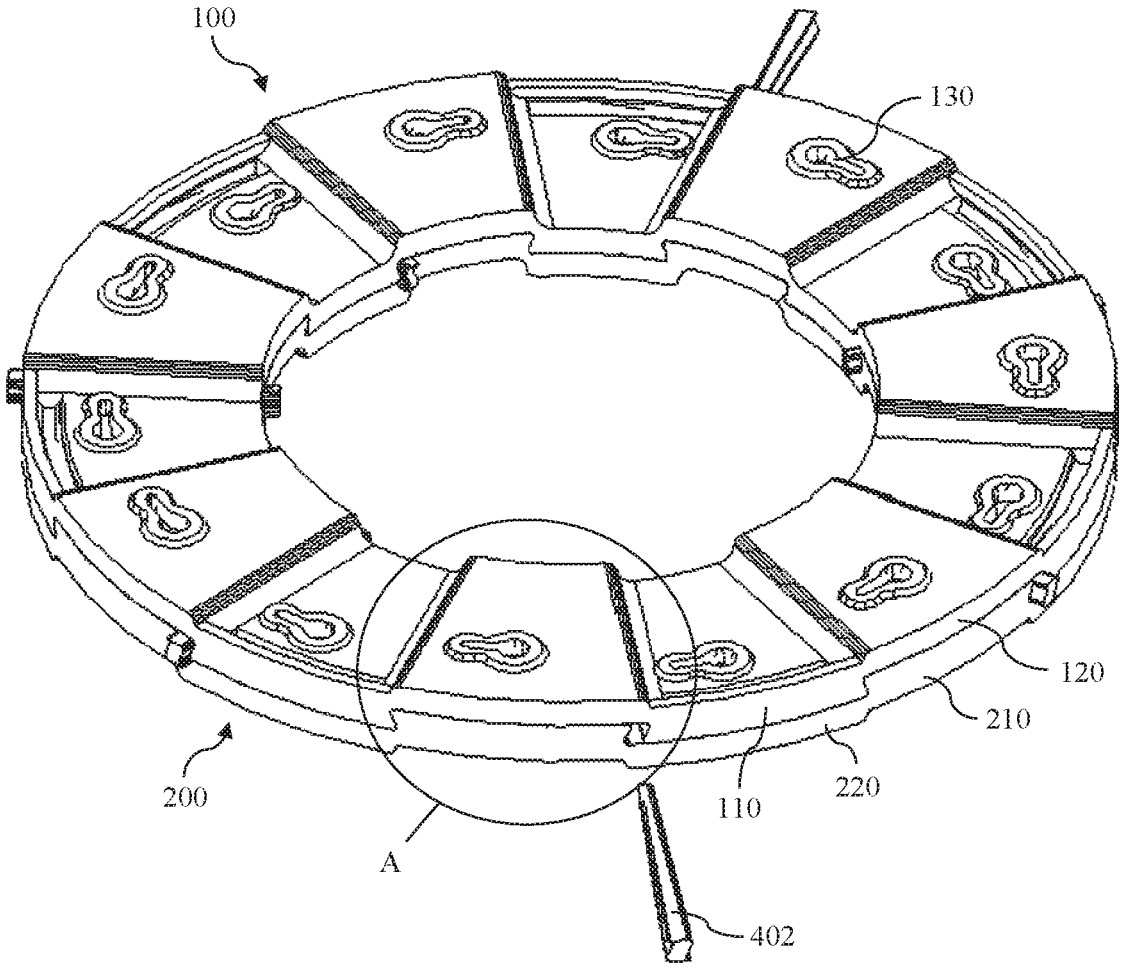
FIG. 3A illustrates a top perspective view of the mated end plates in an interlocking configuration by a rotation movement which embodies therein the principle features of the invention.
Figure 3B:
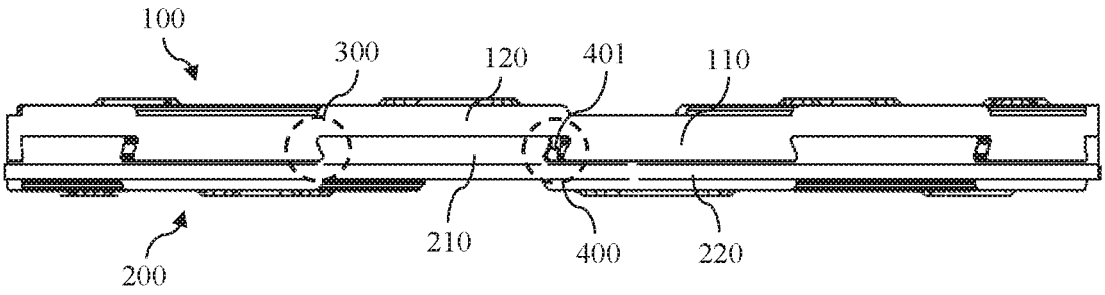
FIG. 3B illustrates a side view of the mated end plates in an interlocking configuration.
Figure 3C:
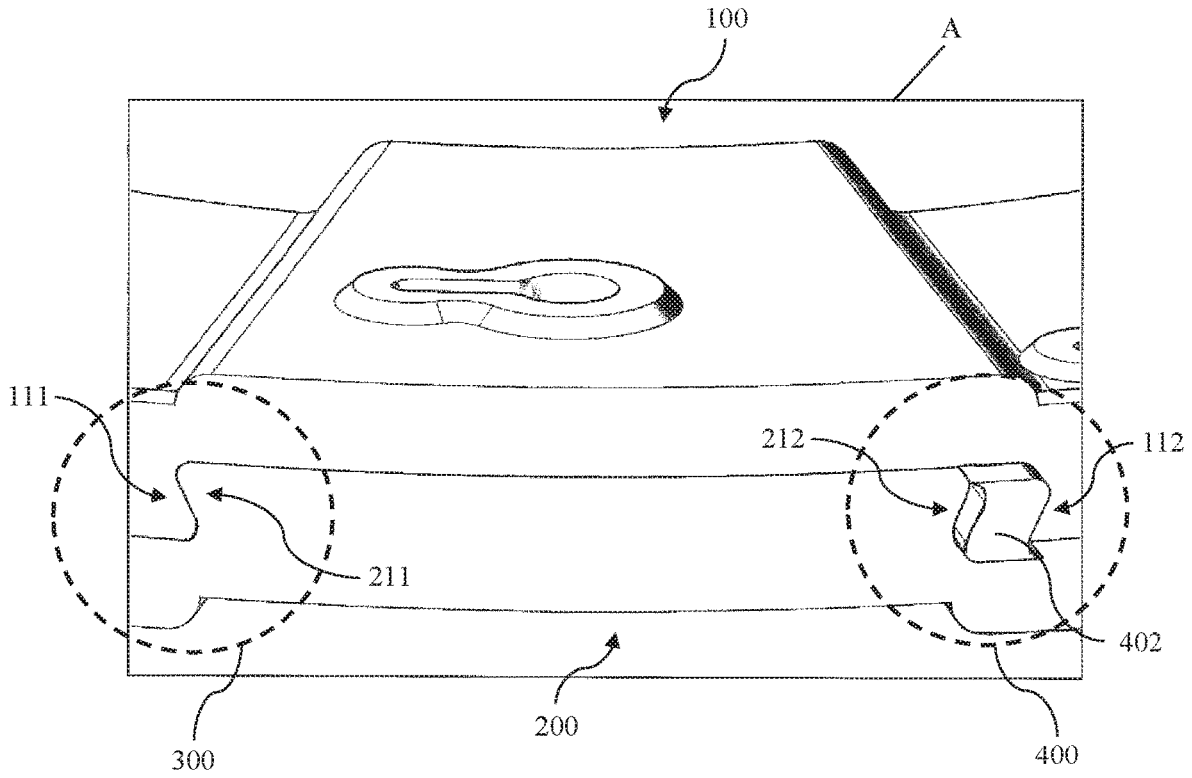
FIG. 3C is an enlarged view taken from section A of FIG. 2A.
Figure 4A:
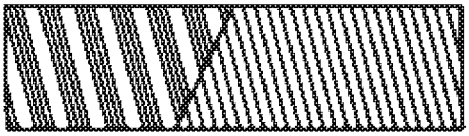
FIG. 4A-4H illustrate eight examples of shapes formed by two adjacent first radial interlocking profiles of the end plates.
Figure 4B:
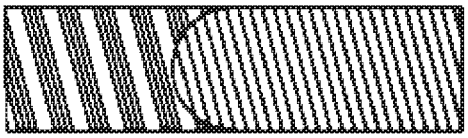
Figure 4C:
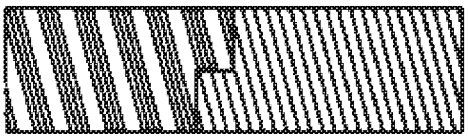
Figure 4D:
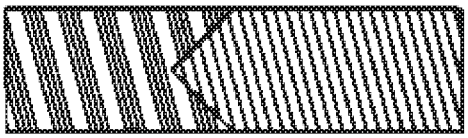
Figure 4E:
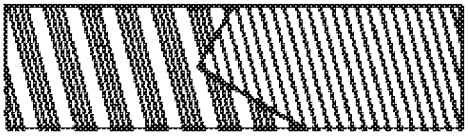
Figure 4F:
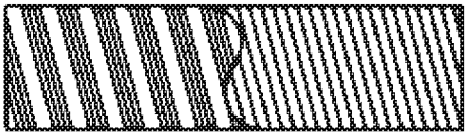
Figure 4G:
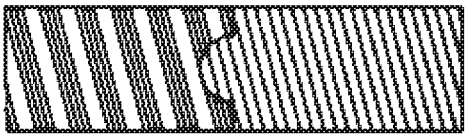
Figure 4H:
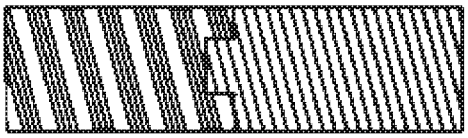
Figure 5A:
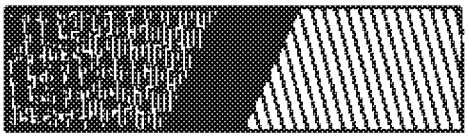
FIG. 5A-5H illustrate eight examples of shapes formed by two adjacent second radial interlocking profiles of the end plates.
Figure 5B:
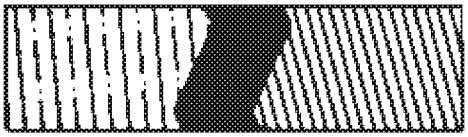
Figure 5C:
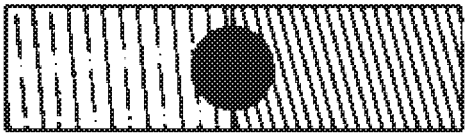
Figure 5D:
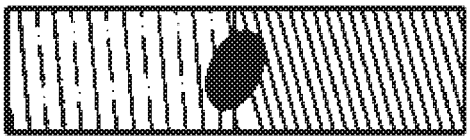
Figure 5E:
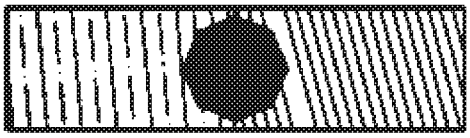
Figure 5F:
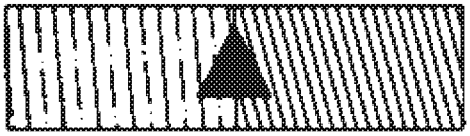
Figure 5G:
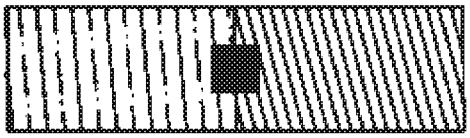
Figure 5H:
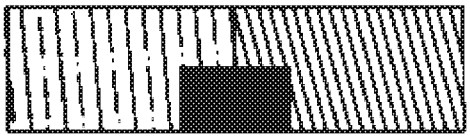

As shown in FIGS. 3A to 3C, through a rotation movement about the central axis of the mated end plates 100, 200, the first interlocking joint 300 is formed by a pair of adjacent first radial interlocking profiles 111, 211 in full surface contact, and a second interlocking joint 400 is created by inserting a pin 402 into a passageway 401 formed between two adjacent second radial interlocking profiles 112, 212. The first interlocking joint 300 effectively prevents the end plates 100, 200 from further movement while the pins 402 are being hammered into the passageways 401. The first interlocking joint 300 is interlocked without pins 402 and it is even stronger than the second interlocking joint 400 to sustain stresses and resist bending and pulling forces.

Preferably, the second radial interlocking profiles 112, 212 are tapered by a small degree that is sufficient to allow the pin 402 to be held in friction when jammed into the passageway 401. This tapered feature is constructed to provide tolerance for easy insertion of the pins 402 as well as for fitting the segmental protrusions 110, 210 of the end plates 100, 200 to the segmental recesses 120, 220. The surface of the pins 402 are preferably able to engage and lock in full surface contact with the corresponding passageways 401 to provide contact bearing resisting forces against the bending movement and axial force along the pile.

As shown in FIGS. 4A to 4H, the first radial interlocking profiles 111, 211 can be respectively configured in Z-shape, semi-circular shape, ledge shape, triangular shape, tilted semi-rectangular shape, S-shape. C-shape, tongue and groove a-like shape or any combination thereof. As shown in FIGS. 5A to 5H, the second radial interlocking profiles 112, 212 can be respectively configured in parallelogram shape, wave shape, circular shape, oval shape, polygonal shape, triangular shape, square shape, rectangular shape or any combination thereof. Preferably, the first and second radial interlocking profiles 111, 211, 112, 212 can have a same interlocking profile with symmetry in the cross-section about the x-axis and y-axis at the mid-point in the interlocking profile, where the z-axis is taken to be perpendicular to the surface plane of the endplates so that any of the radial interlocking profiles 111, 211, 112, 212 can be transformed into either the first interlocking joint 300 or the second interlocking joint 400. As such, the end plates 100, 200 can be rotated in both directions to form the first and second interlocking joints 300, 400.

TECHNICAL ASPECTS OF THE INVENTION

Figure 1A:
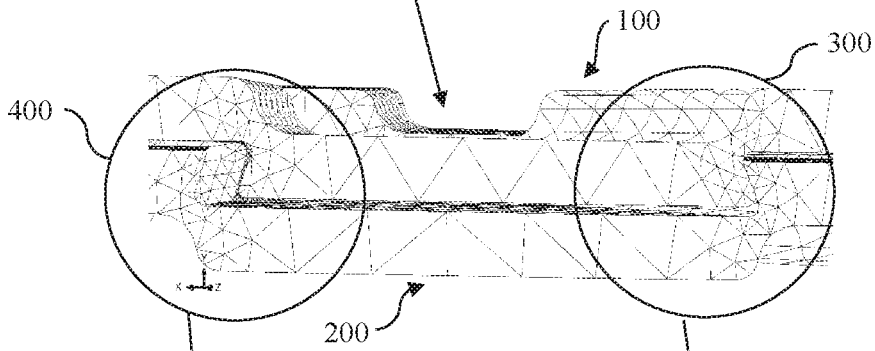
Figure 1B:
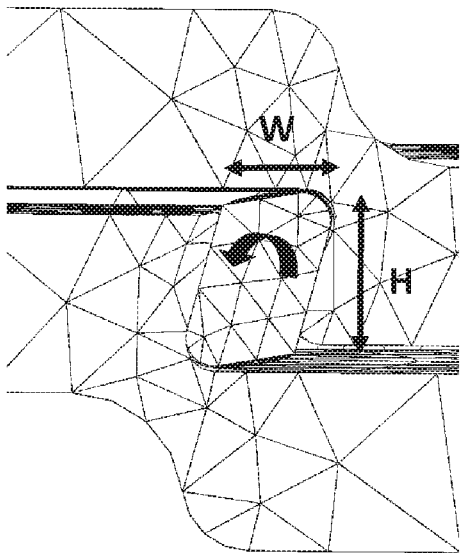
Figure 1C:
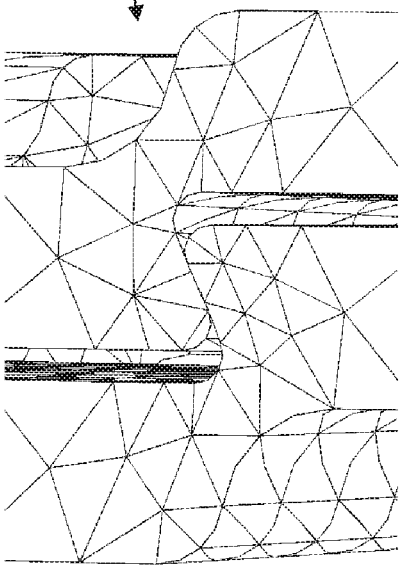

The interlocked endplates 100, 200 in FIG. 1 has been designed to exceed the main body of the pile in axial tension, bending, twisting and axial compression. To securely interlock the mated endplates 100, 200, a tapered locking pin 402 can be inserted to any of the openings of the passageway 401. As seen in FIG. 1A and FIG. 1B, the passageway on one side of the mated endplates 100, 200 is jammed with a tapered locking pin 402 and the opposite side as in FIG. 1C experienced an equal opposite jamming force thereby binding the two-contacting first adjacent radial interlocking profiles 111, 211 in the segmental protrusions 110, 210 of the top and bottom endplates 100, 200 together. It is noted in FIG. 5B, that when the endplates 100, 200 undergoes a tension force or bending, it resulted in a large rotational moment caused by the pulling tension force in the z-axis perpendicular to the surface plane of the mated endplates that rotates the tapered locking pin 402 along the longitudinal axis causing deformation stresses in the contacting surfaces 112, 212 between the passageways of the protrusions 110, 210 and tapered locking pin 402. This is unlike the endplates 100, 200 in FIG. 1C wherein the opposite two-contacting first adjacent radial interlocking profiles 111, 211 binds together without the tapered locking pin 402 to experience pure vertical shear. Through the interlocking of the pure vertical shear in two-contacting first adjacent radial interlocking profiles 111, 211 of the protrusions 110, 210, it can withstand very large pulling tension forces and hence strengthened the weaker interlocked tapered locking pin 402 to produce a more superior endplate joint. As seen in the detail in FIG. 1B, the rotation force becomes more significant as the width of the tapered locking pin 402, "W" becomes larger. It is therefore the object of this invention to reduce the ratio of width to the height of the tapered locking pin 402, "W/H" to be preferably less than 1 at the largest end of the tapered locking pin 402, and yet provide sufficient clearance for the top and bottom endplates 100, 200 to be mated. Therefore, the shape of the pin 402 must have a small taper and be slender, also it must be mentioned that towards the tapering end of the tapered locking pin 402, the ratio of "W/H" is considerably less than 0.5. Thus, by jamming the tapered locking pin 402 into the opening using a hammer or any horizontal force the friction resistance is more than sufficient to prevent it from being permanently dislodged.

A single stage hot forging process is preferred to the costlier multiple hot forging stages using multiple moulds to allow the complexities of having different thickness and shapes in the forged work piece. In this present invention, unlike as in a casting process, the shape of the endplates 100, 200 in the present invention is dictated by the material flow displacement in the steel annulus plate of uniform thickness under a single stage Hot Forging Closed Mold process. It is preferable to start the forging work piece as a pre-formed annulus plate, therefore in this process of forging manufacturing, the endplates 100, 200 are specially restricted to have more uniform thickness and lower embossed material flows to create small localised increased thickness, unlike as in the casting process which can produce vastly different thickness and width as required for the joints in the prior arts. This single stage Hot Forging Closed Mold process however has a great advantage as it dramatically reduces the costs and increase speed of mass manufacturing as compared to casting or machining from a solid piece.

For thinner endplates, it may be cold form under heavy press to bend the endplates 100, 200 into the interlocking profile edges 111, 211, 112, 212. However, the material flows are limited, thereby it may not possible to create large embossment.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

What is claimed is:

1. An end plate system for joining spun piles together, the end plate system comprising:

a top end plate (100) configured to be mounted at a bottom end of a first spun pile;

a bottom end plate (200) configured to be mounted at a top end of a second spun pile; wherein:

the top end plate (100) has a plurality of first segmental protrusions (110) and a plurality of first segmental recesses (120) and the bottom end plate (200) has a plurality of second segmental protrusions (210) and a plurality of second segmental recesses (220) arranged in an alternate configuration; each of the first segmental protrusions (110) of the top end plate (100) comprises a first radial interlocking profile (111) and a second radial interlocking profile (112), and each of the second segmental recesses (220) of the bottom end plate (200) comprises a third radial interlocking profile (211) and a fourth radial interlocking profile (212), and the radial interlocking profiles (111, 112, 211, 212) extend towards a centre of the end plates (100, 200);

the top end plate (100) and the bottom end plate (200) are mated by registering each of the plurality of first segmental protrusions (110) of the top end plate (100) to a respective segmental recess (120) of the plurality of second segmental recesses (120) of the bottom end plate (200); and through rotating about the centre of the mated end plates (100, 200), each of the first radial interlocking profiles (111) of the top end plate (100) meets a respective third radial interlocking profile (211) of the plurality of third radial interlocking profiles of the bottom end plate (200) to form a full surface contact first interlocking joint (300), and each of the second radial interlocking profiles (112) of the top end plate (100) meets a respective fourth radial interlocking profile (212) of the plurality of fourth radial interlocking profiles of the bottom end plate (200) forming a passageway (401); and a pin (402) is configured to be inserted into the passageway (401) formed at the mating of the top end plate (100) and the bottom end plate (200), wherein:

the pin (402) has a tapered configuration and comprises an external surface, wherein the insertion of the pin (402) into the passageway (401) causes the external surface of the pin (402) to interface with the passageway (401);

the pin is dimensioned in a manner that the cross-sectional area of the pin (402) across its axis at a first position is greater than the cross-sectional area of the passageway (401) at a corresponding position, such that the insertion of the pin (402) into the passageway (401) results in jamming of the pin (402) in the passageway (401); and the pin (402) is dimensioned in a manner that the insertion of the pin (402) into the passageway (401) causes compression of the top end plate (100) and the bottom end plate (200) to create a post compressive force to transfer pre-stressed tendons load.

2. The end plate system according to claim 1, wherein each of the first radial interlocking profiles (111) and each of the second radial interlocking profiles (211) of the top end plate (100) are identical to each of the third interlocking profiles (211) and each of the fourth interlocking profiles (212) of the bottom end plate (200), so that the end plates (100, 200) are rotated in either a clockwise or an anticlockwise direction to form the first and a second interlocking joints (300, 400).

3. The end plate system according to claim 1, wherein the first and third radial interlocking profiles (111, 211) when in full contact with each other are configured in Z-shape, semi-circular shape, ledge shape, triangular shape, tilted semi-rectangular shape, S-shape, C-shape, or in any combination thereof.

4. The end plate system according to claim 1, wherein the second and fourth radial interlocking profiles (112, 212) respectively are configured in parallelogram shape, wave shape, circular shape, oval shape, polygonal shape, triangular shape, square shape, rectangular shape, or in any combination thereof.

5. The end plate system according to claim 3 or claim 4, wherein the first and third radial interlocking profiles (111, 211) are not identical to the second and fourth radial interlocking profiles (112, 212) respectively.

6. The end plate system according to claim 1, wherein the second and fourth radial interlocking profiles (112, 212) and the pins (402) are tapered.

7. The end plate system according to claim 1, wherein the first, the second, the third and the fourth radial interlocking profiles (111, 211, 112, 212) respectively are formed by hot forging process or cold form press.

* * * * *